United States Patent [19]

Ward et al.

[11] 3,995,825

[45] Dec. 7, 1976

[54] FORM TIE FOR CONCRETE FORM STRUCTURES

[76] Inventors: Edward B. Ward; Ronald A. Ward, both of 824 Winchester, Kansas City, Mo. 64125

[22] Filed: Aug. 1, 1975

[21] Appl. No.: 601,019

[52] U.S. Cl. ..... 249/41; 52/99; 249/214

[51] Int. Cl.[2] ..... E04g 11/06

[58] Field of Search ..... 52/98, 99; 249/214, 249/41

[56] References Cited

UNITED STATES PATENTS

| | | | |
|---|---|---|---|
| 1,224,810 | 5/1917 | Tenholder | 52/99 X |
| 1,919,751 | 7/1933 | Schenk | 249/214 X |
| 2,483,560 | 10/1949 | Peterson | 52/99 |
| 2,887,758 | 5/1959 | Clark | 249/214 |
| 3,173,187 | 3/1965 | Pontiere | 249/214 |
| 3,396,936 | 8/1968 | Bowden | 249/214 |

OTHER PUBLICATIONS

Acrow Review, vol. II, No. 37, June 1964, p. 22.

*Primary Examiner*—Alfred C. Perham
*Attorney, Agent, or Firm*—Fishburn, Gold & Litman

[57] ABSTRACT

An elongated form tie bar extends transversely across a concrete receiving space between facing side forms and has opposite end portions thereof each positioned between respective abutting side edge portions of adjacent side forms. The end portions of the tie bar are each adapted to receive respective form holding members for retaining the abutting side edge portions of adjacent side forms in abutting engagement. The tie bar is of carbon steel and has hardened fracture planes positioned relative to the opposite end portions and an intermediate portion thereof whereby after setting of the concrete wall and removal of the forms the end portions are adapted to be separated from the intermediate portion upon being struck a blow as by a hammer and the ends of the remaining intermediate portion are recessed in the concrete wall.

7 Claims, 6 Drawing Figures

Fig. 1.
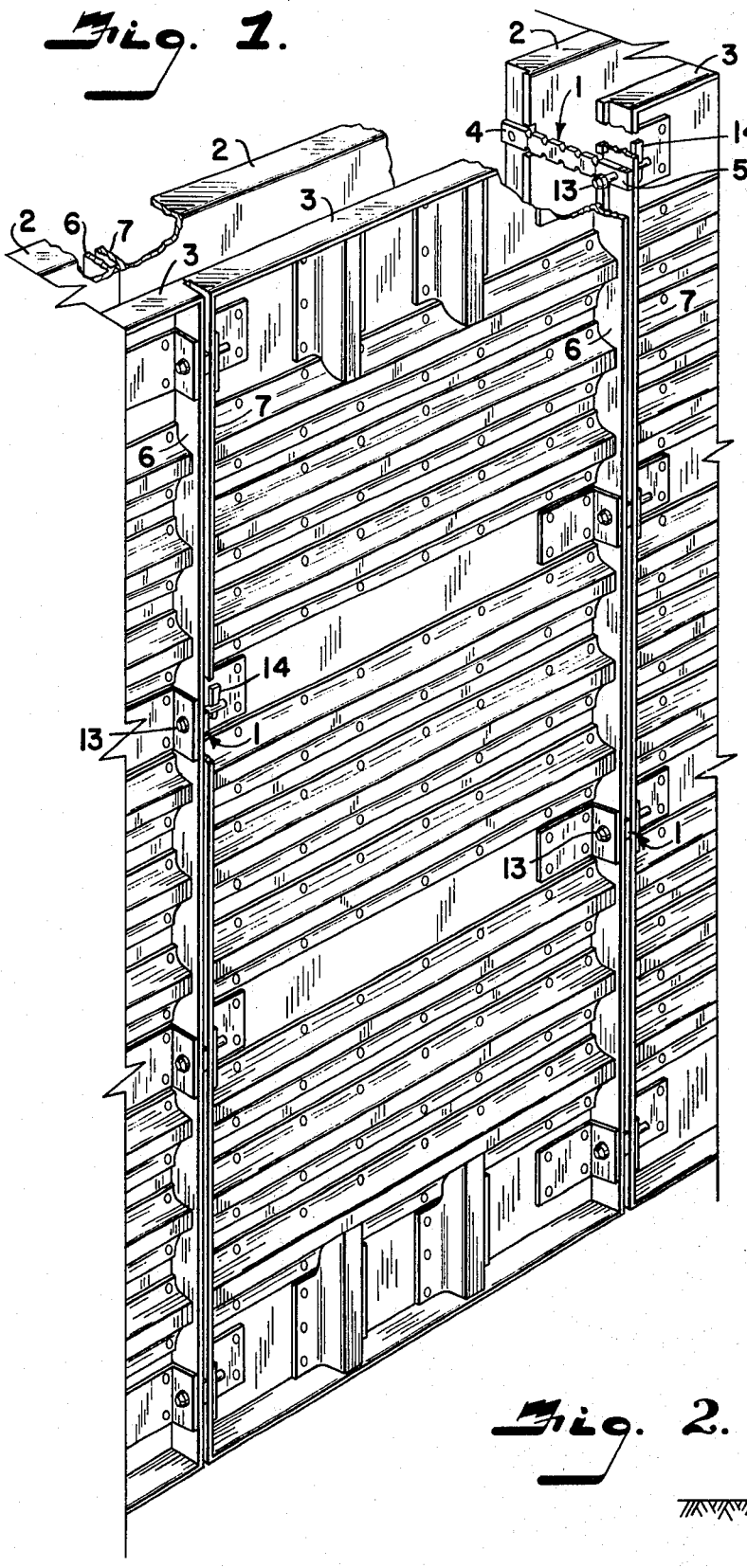
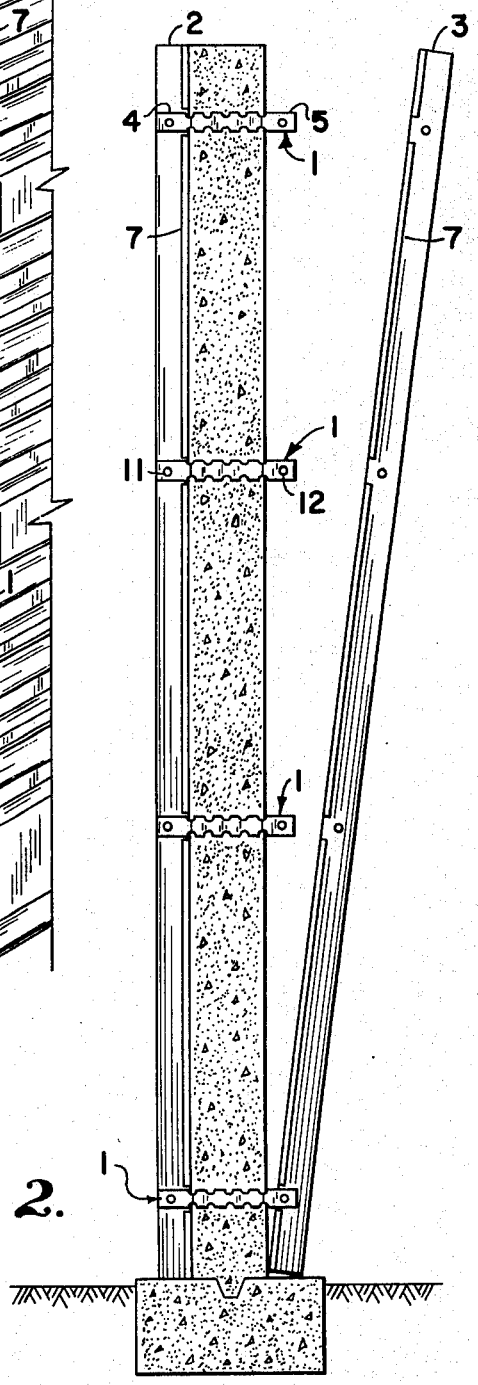
Fig. 2.

FORM TIE FOR CONCRETE FORM STRUCTURES

The present invention relates to concrete form structures and more particularly to a form tie having breakoff end portions.

Form ties have been manufactured of high carbon steel which is a specialty steel that has become unavailable and when available the cost is so high that it is substantially impractical to use same. Also form ties have been heat treated to make same brittle to permit removal of exposed end portions thereof but the heat treating is expensive making the tie cost excessive. Form ties are usually generally rectangular bars and end portions broken off by striking and bending same and if the breakoff point thereof is recessed in the wall the bending of the tie damages the adjacent wall portion and forms large holes which are particularly difficult to patch satisfactorily in textured wall finishes, such as simulated brick or other patterns.

The principal objects of the present invention are: to provide a form tie for concrete form structures adapted to overcome the above mentioned difficulties and is of substantial strength to resist separation of side forms secured thereby; to provide such a form tie formed of low carbon steel with work hardened fracture planes thereby providing improved breakoff of the end portions and particularly improved vertical breakoff; to provide such a form tie wherein the fracture planes are positioned within the finished concrete wall whereby on separation a small recess remains and is easily filled to conceal ends of the remaining portion of the tie bar; to provide such a tie bar that is particularly adapted for use with forms for providing textured surfaces; to provide such a tie bar having a plurality of notches in opposite side edge portions thereof with the fracture planes extending between certain of the notches thereby forming smaller recesses and providing a minimum of exposed metal in the recess after breakoff of the end portions; to provide such a tie bar which is a planar member adapted for vertical breakoff; and to provide such a tie bar which is economical to manufacture, durable in construction, resists imposed load, and is particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the form tie for concrete form structures.

FIG. 1 is a perspective view of a concrete form structure with portions broken away to better illustrate a form tie therefor embodying features of the present invention.

FIG. 2 is a transverse sectional view through a concrete wall showing one side form being removed.

Figure 4:
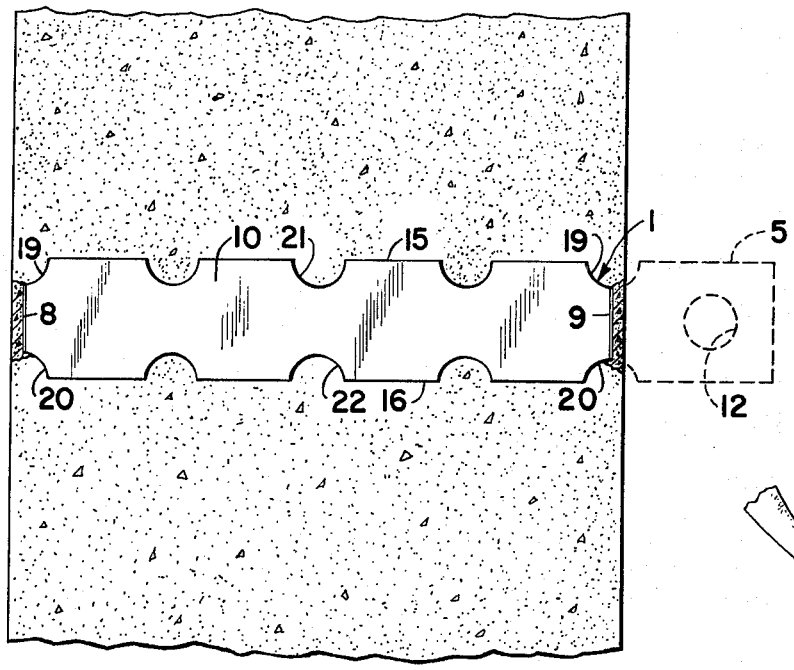
FIG. 4 is an enlarged fragmentary transverse sectional view showing an intermediate portion of the tie bar remaining in the concrete wall.
Figure 3:
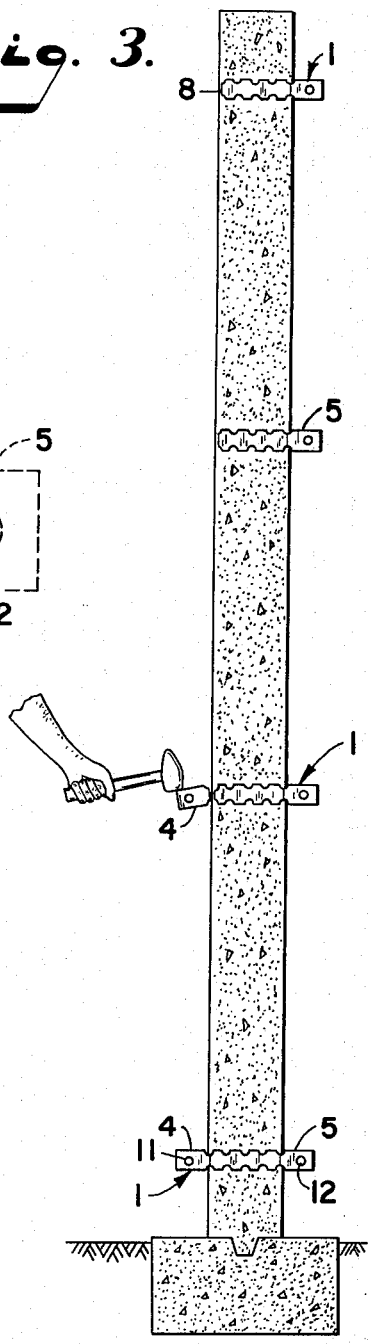
FIG. 3 is a transverse sectional view similar to FIG. 2 except showing an end portion of a tie bar during breakoff thereof.
Figure 6:
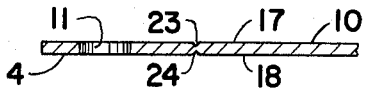
FIG. 6 is an enlarged fragmentary longitudinal sectional view taken on line 6—6 of FIG. 5 and illustrating the fracture plane.
Figure 5:
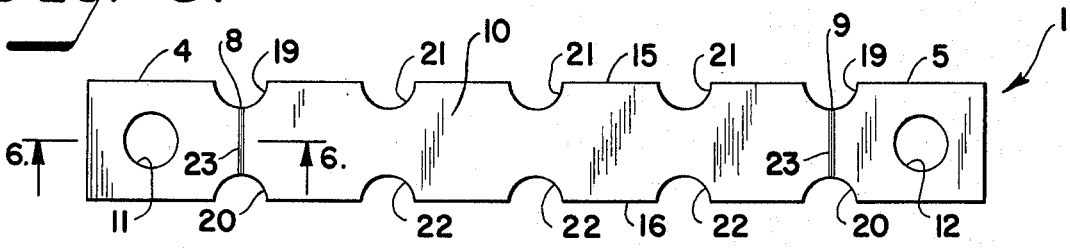
FIG. 5 is an enlarged side elevational view of the tie bar.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally an elongated form tie of a flat bar of carbon steel extending transversely across a concrete receiving space between facing side forms 2 and 3. The form tie bar 1 has opposite end portions 4 and 5 thereof each positioned between respective abutting side edge portions 6 and 7 of adjacent side forms 2 and 3. The end portions 4 and 5 of the tie bar 1 are each adapted to receive respective form holding members therein for retaining the abutting side edge portions 6 and 7 of the adjacent side forms 2 and 3 in abutting engagement. The tie bar 1 has a pair of fracture planes 8 and 9 each positioned between a respective one of the opposite end portions 4 and 5 and an intermediate portion 10 thereof whereby the end portions 4 and 5 are each adapted to be separated from the intermediate portion 10 upon being struck vertically thereon.

In the illustrated embodiment, the tie bar 1 has apertures 11 and 12 in the opposite end portions 4 and 5 respectively. The apertures 11 and 12 each receive therein suitable means for holding the abutting side edge portions 6 and 7 of respective side forms 2 and 3 in abutting engagement. The holding means is illustrated as a plurality of vertically spaced pins 13 adapted to extend through respective aligned apertures in abutting side edge portions 6 and 7. Each pin 13 has a head at one end and a suitable slot adjacent the other end to removably receive a wedge 14 therein to clamp the forms between the head and wedge.

The tie bar 1 is a generally rectangular planar member having opposite side edge portions 15 and 16 and opposite faces 17 and 18 and is illustrated as having a plurality of end notches 19 and 20 in the side edge portions 15 and 16 respectively. The notches 19 and 20 are positioned in laterally opposed alignment and arranged so that the fracture planes 8 and 9 each extend between a respective pair of the aligned notches or cut out portions 19 and 20.

The intermediate portion 10 of the tie bar 1 preferably has a plurality of notches or cut out portions 21 and 22 in the side edge portions 15 and 16 respectively to serve as rod holders for reinforcing rods or bars in the form.

The tie bar 1 of the present invention may be a rectangular planar member with the fracture planes 8 and 9 extending thereacross in a spaced relation to the apertures 11 and 12 whereby the fracture planes 8 and 9 are spaced inwardly of the inner faces of the forms 2 and 3 and the break line will be recessed in the concrete wall when the end portion is separated from the intermediate portion 10. The bar 1 is of a carbon steel that has tensile strength to assume holding of the forms against the pressure of the concrete when poured. It is preferred that the tie bar have notches in opposite edges at the fracture planes 8 and 9 to reduce the breaking force required and to reduce the size of the recess in the concrete remaining after breaking off the end portions 4 and 5 of the bars. The shape of the notches 19 and 20 may be square, V-shaped, or other shapes, however, in the illustrated structure, they are half circles with the fracture planes at the narrowest point. This aids in assuring the break at the desired line. Also the bar is hardened at the fracture plane to assure proper breaking under a hammer blow on an upper outer corner of the end portion of the bar extending from the concrete wall. The hardening is concentrated at the fracture planes 8 and 9 so the bars have the strength for linear forces and the ability to withstand rough handling during use without any breakage except the selective breaking after the forms are removed from the concrete wall.

The fracture planes 8 and 9 are defined by first and second pairs of opposed grooves 23 and 24 in the tie bar 1. Each pair of opposed grooves 23 and 24 are positioned between a respective one of the end portions 4 and 5 and the intermediate portion 10. The grooves 23 and 24 of each pair of grooves are each positioned in a respective opposite face 17 and 18 of the tie bar 1 and the grooves 23 and 24 extend between the end notches 19 and 20. The end portions 4 and 5 are thereby adapted to be separated from the intermediate portion 10 of the tie bar 1 upon being struck vertically thereon.

The tie bar 1 is formed of a carbon steel which is supplied in strip form. A suitable steel is in the nature of a 1,040 carbon steel which means it has 40 points carbon. The apertures 11 and 12 and apertures for the end notches 19 and 20 and the center or intermediate notches 21 and 22 are formed by punching in the strip of steel. Rounded or radius corners at the ends of the end portions 4 and 5 may also be formed during punching or during cutting of the strip into the tie bars 1. The hardening at the fracture planes is preferably by work hardening to concentrate same. The work-hardening is preferably by coining in which the metal is compressed between two die blades by striking the bar on both sides forming the grooves 23 and 24. Other work-hardens the material between each pair of the end notches 19 and 20 thereby introducing brittleness and insuring a straight line breakoff of the end portions 4 and 5 while retaining sufficient cross sectional area and tensile strength to resist separation of the side forms 2 and 3 during and after pouring concrete into the space between the side forms 2 and 3.

The coined grooves preferably are generally V-shaped and the cross sectional area of the coined portion is at least 25% and not greater than 60% of the cross sectional area of the bar. The tie bars vary in length, width and thickness depending upon the walls being poured. An example of a size of bar is one for forms for a wall having a thickness of approximately 8 inches as a bar 11½ inches long, 1½ inches wide and 0.083 inches thick. The width of the bar at the fracture line is approximately seven-eighths inches. The thickness between the grooves may be reduced by 30 to 60% and is preferably approximately 0.045 to 0.050 inches or a 40 to 45% reduction. In such a bar the fracture area has the strength to withstand a pull of more than 6,200 pounds. The fracture planes of such a bar are spaced so the break is approximately one-fourth inches from the adjacent surface of the concrete wall.

In using a form tie constructed as illustrated and described, the opposed form panels 2 and 3 are positioned on a suitable footing and the tie bars 1 extend across the space for the wall and between adjacent side flanges of adjacent form panels with the end apertures 11 and 12 registering with holes in said form side flanges. The pins 13 are inserted into the apertures in the side edge portions 6 and 7 and the wedge 14 driven into the slots therein to clamp the form side flanges together and make a connection positively holding the form panels in place and spaced to form the cavity for the concrete of the wall. After the concrete is poured and set sufficiently, the wedges 14 are removed, the pins 13 withdrawn, and the form panels 2 and 3 stripped from the wall. The ends 4 and 5 of the tie bars 1 extend from the concrete wall surfaces. Then the upper outer corner of each bar is struck a downward hammer blow and the tie bar breaks vertically leaving a small rectangular recess extending to the break line, as for example, with the tie bar having the dimensions given herein, the recess would be in the nature of 1 inch long, 3/32 inches wide and one-fourth inch deep. The recess is then filled with mortar covering the tie bar ends so the tie bar remains fully enclosed in the wall with no danger of rust or the like appearing on the wall surface as occurs with walls having exposed bars therein.

It is to be understood that while We have illustrated and described one form of our invention, it is not to be limited to the specific form or arrangement of parts herein described and shown.

What we claim and desire to secure by Letters Patent is:

1. A form tie for a concrete structure wherein form panels are held in position defining a cavity for a concrete wall by form ties extending across such cavity comprising:

a. an elongated flat bar of carbon steel having opposed side faces and opposed side edges, said bar being of a length greater than the width of a concrete wall cavity and with opposed end portions to extend beyond such cavity;

b. said end portions of said elongated flat bar having apertures extending therethrough between said side faces for receiving fastening devices to connect to form panels;

c. said flat bar having opposed coined grooves in said opposed side faces extending transversely across same in spaced relation to said apertures whereby the bar has work-hardened fracture areas at said grooves inwardly from a surface of a concrete wall formed in the cavity;

d. said tie bar being characterized by the work-hardened fracture areas breaking under a hammer blow on a side edge of the respective end portion.

2. A form tie as set forth in claim 1 wherein the bar cross sectional area at said coined grooves is 25 to 60% of the original cross sectional area of the bar.

3. A form tie as set forth in claim 2 wherein the bar thickness at the said coined grooves is reduced by 30 to 60% of the original thickness of the bar.

4. A form tie as set forth in claim 1 wherein said bar has notches extending therein from the opposed side edges at said grooves to reduce the width of the tie bar at the fracture areas, said notches being of a width to extend outwardly of said wall cavity to reduce the width at the surface thereof.

5. A form tie as set forth in claim 4 wherein:

a. said opposed grooves form a pair and there is a pair of such grooves spaced from the ends of the bar and defining an intermediate bar portion therebetween;

b. said bar has a plurality of notches extending into said intermediate portion from opposed side edges thereof for receiving reinforcing members for support in the cavity by the tie bar.

6. A form tie as set forth in claim 5 wherein:

a. said opposed grooves are V-shaped;

b. the bar thickness at said grooves is reduced by 30 to 60% of the original thickness of the bar by coining of the grooves.

7. A form tie for a concrete form structure including first and second side forms positioned in facing relation to define therebetween a space to receive concrete, said side forms each having peripheral side edge portions adapted to be positioned in abutting engagement with an adjacent side form, said concrete form structure including means for holding the abutting side edge portions of adjacent side forms in abutting engagement said form tie comprising:

a. an elongated tie bar extending transversely across a space between facing side forms and having opposite end portions thereof each positioned between respective abutting side edge portions of adjacent side forms, said tie bar being a planar member of carbon steel and having opposite side edge portions and opposite faces;

b. means defining a pair of apertures in said elongated tie bar and each positioned in a respective one of said opposite end portions thereof and each adapted to receive respective means for holding abutting side edge portions of adjacent side forms in abutting engagement;

c. said tie bar having a first and second pair of opposed coined grooves in said opposed faces of said tie bar and extending transversely across same, each pair of opposed grooves being positioned between a respective one of said opposite end portions and an intermediate portion of said tie bar, the tie bar thickness being reduced at said grooves by 30 to 60% of the original thickness of the tie bar thereby defining a pair of work-hardened fracture planes whereby each of said end portions is adapted to be separated from the intermediate portion of said tie bar upon being struck thereon;

d. means defining a plurality of notches in said tie bar and each positioned in a respective one of the opposite side edge portions thereof, certain of said notches being intersected by a respective one of said first and second pair of opposed grooves; and e. the spacing between each of said apertures and the adjacent pair of opposed grooves positions each of said pair of opposed grooves inwardly of an interior face of a respective one of the side forms whereby the intermediate portion of said tie bar may be concealed in a concrete wall.

* * * * *